US011205385B2

(12) United States Patent
Feng et al.

(10) Patent No.: US 11,205,385 B2
(45) Date of Patent: Dec. 21, 2021

(54) DISPLAY PANEL AND METHOD OF CONTROLLING THE SAME, AND DISPLAY APPARATUS

(71) Applicants: HEFEI BOE JOINT TECHNOLOGY CO., LTD., Hefei (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/857,749

(22) Filed: Apr. 24, 2020

(65) Prior Publication Data

US 2021/0035501 A1 Feb. 4, 2021

(30) Foreign Application Priority Data

Jul. 31, 2019 (CN) ..... 201910700945.7

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2310/0297* (2013.01)

(58) Field of Classification Search
CPC .. G09G 3/3258; G09G 3/3266; G09G 3/3291; G09G 2310/0297; G09G 3/30;
(Continued)

(56) References Cited

U.S. PATENT DOCUMENTS

2015/0062192 A1* 3/2015 Kim ..... G09G 3/3291 345/690
2015/0179107 A1 6/2015 Kim
(Continued)

FOREIGN PATENT DOCUMENTS

CN 103049147 A 4/2013
CN 104732916 A 6/2015
(Continued)

OTHER PUBLICATIONS

Notification of the First Office Action issued in Chinese Patent Application No. 201910700945.7, dated Jun. 3, 2021, with English translation.

*Primary Examiner* — Kent W Chang
*Assistant Examiner* — Sujit Shah
(74) *Attorney, Agent, or Firm* — McDermott Will and Emery LLP

(57) ABSTRACT

A display panel includes a plurality of pixel driving circuits and a plurality of sense lines. The pixel driving circuits are capable of being divided into a plurality of rows of pixel driving circuits each arranged in a first direction and divided into a plurality of columns of pixel driving circuit each arranged in a second direction intersected with the first direction. Each pixel driving circuit includes a detection transistor. The sense lines are arranged at intervals and extending along the second direction, and are configured to provide reference voltage signals to the plurality of pixel driving circuits. Each detection transistor is electrically connected to one of the plurality of sense lines, and in pixel driving circuits in a same column, detection transistors in any two adjacent rows are electrically connected to different sense lines.

10 Claims, 12 Drawing Sheets

(58) Field of Classification Search
CPC ..... G09G 3/32; G09G 3/3208; G09G 3/3216; G09G 32/3225; G09G 3/3233; G09G 3/3241; G09G 3/325
See application file for complete search history.

(56) References Cited

U.S. PATENT DOCUMENTS

| | | | | |
|---|---|---|---|---|
| 2015/0294626 | A1* | 10/2015 | Bi | G09G 3/3233 345/211 |
| 2016/0071445 | A1* | 3/2016 | Kim | G09G 3/006 345/212 |
| 2017/0061871 | A1 | 3/2017 | Xiang et al. | |
| 2017/0169767 | A1 | 6/2017 | Song | |
| 2018/0012546 | A1* | 1/2018 | Li | G09G 3/3233 |
| 2018/0061316 | A1* | 3/2018 | Shin | G09G 3/3266 |
| 2018/0322829 | A1* | 11/2018 | Xie | G09G 3/3233 |
| 2018/0350303 | A1 | 12/2018 | Jin | |
| 2019/0066591 | A1 | 2/2019 | Xu et al. | |
| 2019/0079606 | A1 | 3/2019 | Kim et al. | |
| 2020/0020278 | A1* | 1/2020 | Lee | G09G 3/3275 |
| 2020/0212137 | A1 | 7/2020 | Wang et al. | |

FOREIGN PATENT DOCUMENTS

| | | | |
|---|---|---|---|
| CN | 106057130 | A | 10/2016 |
| CN | 106909008 | A | 6/2017 |
| CN | 107093402 | A | 8/2017 |
| CN | 107393469 | A | 11/2017 |
| CN | 108649059 | A | 10/2018 |
| CN | 109243347 | A | 1/2019 |
| CN | 109491531 | A | 3/2019 |
| JP | H11-112327 | A | 4/1999 |

* cited by examiner

DISPLAY PANEL AND METHOD OF CONTROLLING THE SAME, AND DISPLAY APPARATUS

CROSS-REFERENCE TO RELATED APPLICATION

This application claims priority to Chinese Patent Application No. 201910700945.7, filed on Jul. 31, 2019, which is incorporated herein by reference in its entirety.

TECHNICAL FIELD

The present disclosure relates to the field of display technologies, and in particular, to a display panel and a method of controlling the same, and a display apparatus.

BACKGROUND

Organic light emitting diode (OLED) displays have the advantages of self-luminescence, light and thin, low power consumption, high contrast, wide color gamut, and flexible display. Active matrix organic light emitting diode (AMOLED) displays have been widely used in various electronic devices including computers, mobile phones and other electronic products due to their advantages of a fast response time, a high luminous efficiency, a high brightness, and a wide viewing angle.

SUMMARY

In one aspect, a display panel is provided. The display panel includes a plurality of pixel driving circuits and a plurality of sense lines. The pixel driving circuits are capable of being divided into a plurality of rows of pixel driving circuits each arranged in a first direction and divided into a plurality of columns of pixel driving circuit each arranged in a second direction intersected with the first direction. Each pixel driving circuit includes a detection transistor. The sense lines are arranged at intervals and extending along the second direction, and are configured to provide reference voltage signals to the plurality of pixel driving circuits. Each detection transistor is electrically connected to one of the plurality of sense lines, and in pixel driving circuits in a same column, detection transistors in any two adjacent rows are electrically connected to different sense lines.

In some embodiments, detection transistors in pixel driving circuits in a column are electrically connected to N sense lines sequentially and cyclically, and N is an integer greater than or equal to two.

In some embodiments, detection transistors in pixel driving circuits in each column are electrically connected to two sense lines sequentially and cyclically.

In some embodiments, the display panel further includes a gate driving circuit configured to provide second scanning signals to detection transistors in the pixel driving circuits in the column. Second scanning signals provided to detection transistors in an i-th row to an (i+N−1)-th row in the pixel driving circuits in the column overlap in a signal cycle, and a second scanning signal provided to a detection transistor in the i-th row does not overlap with a second scanning signal provided to a detection transistor in an (i+N)-th row in the signal cycle. Herein, i is an integer greater than or equal to 1.

In some embodiments, the display panel further includes a plurality of controllers. Each controller is electrically connected to a sense line, and is configured to provide a reference voltage signal to a pixel driving circuit through the sense line.

In some embodiments, the controller includes a first switch, a second switch, a sample hold circuit, and an analog-to-digital converter. The sense line is electrically connected to the sample hold circuit through the first switch, and the sample hold circuit is electrically connected to the analog-to-digital converter. The sense line is further electrically connected to a reference voltage terminal through the second switch.

In some embodiments, each pixel driving circuit further includes a first switching transistor, a driving transistor, a storage capacitor, and a light emitting device. A gate of the first switching transistor is electrically connected to a first scanning terminal, a first electrode of the first switching transistor is electrically connected to a data signal terminal, and a second electrode of the first switching transistor is electrically connected to a first electrode of the storage capacitor and a gate of the driving transistor. The first electrode of the storage capacitor is further electrically connected to the gate of the driving transistor, and a second electrode of the storage capacitor is electrically connected to a second electrode of the driving transistor, a first electrode of the detection transistor and one electrode of the light emitting device. A first electrode of the driving transistor is electrically connected to a first power voltage terminal, and the second electrode of the driving transistor is further electrically connected to the one electrode of the light emitting device and the first electrode of the detection transistor. A gate of the detection transistor is electrically connected to a second scanning terminal, the first electrode of the detection transistor is further electrically connected to the one electrode of the light emitting device, and a second electrode of the detection transistor is electrically connected to a sense line. Another electrode of the light emitting device is electrically connected to a second power voltage terminal.

In some embodiments, the pixel driving circuit further includes a second switching transistor, a gate of the second switching transistor is electrically connected to a transmitting terminal, a first electrode of the second switching transistor is electrically connected to the first power voltage terminal, and a second electrode of the second switching transistor is electrically connected to the first electrode of the driving transistor.

In another aspect, a display apparatus is provided. The display apparatus includes any one of the display panels described above.

In yet another aspect, a method of controlling any one of the display panels described above is provided. The method includes: in a pixel data writing stage of a display period of the display panel, providing scanning signals to pixel driving circuits in a row to turn on the pixel driving circuits in the row, and providing reference voltage signals to the pixel driving circuits in the row through sense lines electrically connected to the pixel driving circuits in the row; in a data writing stage of a compensation detection period of the display panel, providing scanning signals to the pixel driving circuits in the row to turn on the pixel driving circuits in the row, and providing the reference voltage signals to the pixel driving circuits in the row through the sense lines electrically connected to the pixel driving circuits in the row; in a sampling stage of the compensation detection period of the display panel, providing scanning signals to the pixel driving circuits in the row to turn on the pixel driving circuits in the row, and collecting voltages at the sense lines electrically connected to the pixel driving circuits in the row;

and in a data writing-back stage of the compensation detection period of the display panel, providing scanning signals to the pixel driving circuits in the row to turn on the pixel driving circuits in the row, and providing the reference voltage signals to the pixel driving circuits in the row through the sense lines electrically connected to the pixel driving circuits in the row.

In some embodiments, in a case where the display panel further includes a plurality of controllers, each controller includes a first switch and a second switch, and each sense line is electrically connected to a reference voltage terminal through a second switch in a controller, the step of providing the reference voltage signals to the pixel driving circuits in the row through the sense lines electrically connected to the pixel driving circuits in the row, includes: controlling second switches electrically connected to the pixel driving circuits in the row through the sense lines to be turned on, and controlling second switches electrically connected to remaining sense lines and all first switches to be turned off to provide the reference voltage signals from the reference voltage terminals to the pixel driving circuits in the row.

In some embodiments, in a case where the controller further includes a sample hold circuit and an analog-to-digital converter; the sense line electrically connected to the controller is electrically connected to the sample hold circuit through the first switch, and the sample hold circuit is electrically connected to the analog-to-digital converter, the step of collecting the voltages at the sense lines electrically connected to the pixel driving circuits in the row, includes: controlling first switches electrically connected to the pixel driving circuits in the row through the sense lines to be turned on; controlling first switches electrically connected to remaining sense lines and all second switches to be turned off; collecting, by sample hold circuits, the voltages at the sense lines; and outputting, by the sample hold circuits, the voltages to analog-to-digital converters.

In some embodiments, in a case where each pixel driving circuit further includes a first switching transistor, a driving transistor, a storage capacitor, and a light emitting device; a gate of the detection transistor is electrically connected to a second scanning terminal, a first electrode of the detection transistor is electrically connected to a first control node, and a second electrode of the detection transistor is electrically connected to a sense line; a gate of the first switching transistor is electrically connected to a first scanning terminal, a first electrode of the first switching transistor is electrically connected to a data signal terminal, and a second electrode of the first switching transistor is electrically connected to a second control node; a first electrode of the storage capacitor is electrically connected to the second control node, and a second electrode of the storage capacitor is electrically connected to the first control node; a first electrode of the driving transistor is electrically connected to a first power voltage terminal, a second electrode of the driving transistor is electrically connected to the first control node, and a gate of the driving transistor is electrically connected to the second control node; one electrode of the light emitting device is electrically connected to the first control node, and another electrode of the light emitting device is electrically connected to a second power voltage terminal, in the pixel data writing stage of the display period of the display panel, the step of providing scanning signals to the pixel driving circuits in the row to turn on the pixel driving circuits in the row, and providing the reference voltage signals to the pixel driving circuits in the row through the sense lines electrically connected to the pixel driving circuits in the row, includes: providing first scanning signals to first scanning terminals to turn on first switching transistors; providing pixel data voltages to data signal terminals, which are then transmitted to second control nodes through the first switching transistors; providing second scanning signals to second scanning terminals to turn on detection transistors; and providing the reference voltage signals to the sense lines, which are then transmitted to first control nodes through the detection transistors; in the data writing stage of the compensation detection period of the display panel, providing scanning signals to the pixel driving circuits in the row to turn on the pixel driving circuits in the row, and providing the reference voltage signals to the pixel driving circuits in the row through the sense lines electrically connected to the pixel driving circuits in the row, include: providing first scanning signals to the first scanning terminals to turn on the first switching transistors; providing pixel data voltages to the data signal terminals, which are then transmitted to the second control nodes through the first switching transistors; providing second scanning signals to the second scanning terminals to turn on the detection transistors; and providing reference voltage signals to the sense lines, which are then transmitted to the first control nodes through the detection transistors; in the sampling stage of the compensation detection period of the display panel, providing scanning signals to the pixel driving circuits in the row to turn on the pixel driving circuits in the row, and collecting the voltages at the sense lines electrically connected to the pixel driving circuits in the row, include: providing first cut-off signals to the first scanning terminals to turn off the first switching transistors; providing second scanning signals to the second scanning terminals to turn on the detection transistors; and collecting voltages at the first control nodes in the pixel driving circuits in the row; and in the data writing-back stage of the compensation detection period of the display panel, providing scanning signals to the pixel driving circuits in the row to turn on the pixel driving circuits in the row, and providing the reference voltage signal to the pixel driving circuits in the row through the sense lines electrically connected to the pixel driving circuits in the row, include: providing first scanning signals to the first scanning terminals to turn on the first switching transistors; providing pixel data voltages to the data signal terminals, which are then transmitted to the second control nodes through the first switching transistors; providing second scanning signals to the second scanning terminals to turn on the detection transistors; and providing reference voltage signals to the sense lines, which are then transmitted to the first control nodes through the detection transistors.

In some embodiments, in a case where the display panel further includes a plurality of controllers, each controller includes a first switch and a second switch, each sense line is electrically connected to the reference voltage terminal through a second switch in a controller, the step of providing the reference voltage signals to the sense lines, which are then transmitted to the first control nodes through the detection transistors, includes: controlling second switches in controllers electrically connected to the sense lines to be turned on, and controlling first switches in the controllers to be turned off, so as to transmit the reference voltage signals from the reference voltage terminals to the first control nodes through the detection transistors.

In some embodiments, in a case where the controller further includes a sample hold circuit and an analog-to-digital converter, the sense line electrically connected to the controller is electrically connected to the sample hold circuit through the first switch, and the sample hold circuit is electrically connected to the analog-to-digital converter, the step of collecting the voltages at the first control nodes in the pixel driving circuits includes: controlling first switches electrically connected to the sense lines to be turned on; controlling second switches electrically connected to the sense lines to be turned off, so as to transmit the voltages at the first control nodes in the pixel driving circuits through the detection transistors; collecting, by the sample hold circuits, the voltages; and converting, by analog-to-digital converters, the voltages into corresponding digital signals.

In some embodiments, the method further includes: in an emission stage of the display period of the display panel, providing first cut-off signals to the first scanning terminals in the pixel driving circuits in the row to turn off the first switching transistors; and providing second cut-off signals to the second scanning terminals in the pixel driving circuits in the row to turn off the detection transistors. Driving transistors in the pixel driving circuits in the row is turned on under control of voltages at the second control nodes, and light emitting devices in the driving circuits in the row emits light.

In some embodiments, the method further includes: after the data writing stage in the compensation detection period, and in a charging stage of the compensation detection period of the display panel, providing first cut-off signals to the first scanning terminals in the pixel driving circuits in the row to turn off the first switching transistors; providing second scanning signals to the second scanning terminals in the pixel driving circuits in the row to turn on the detection transistors; and stopping providing the reference voltage signals to the first control nodes in the pixel driving circuits in the row. The driving transistors in the pixel driving circuits in the row are turned on under control of voltages at the second control nodes to charge the sense lines electrically connected to the pixel driving circuits in the row.

BRIEF DESCRIPTION OF THE DRAWINGS

In order to describe technical solutions in the embodiments of the present disclosure more clearly, accompanying drawings to be used in some embodiments of the present disclosure will be introduced briefly. Obviously, the accompanying drawings to be described below are merely accompanying drawings of some embodiments of the present disclosure, and a person of ordinary skill in the art can obtain other drawings according to these drawings.

Figure 1A:
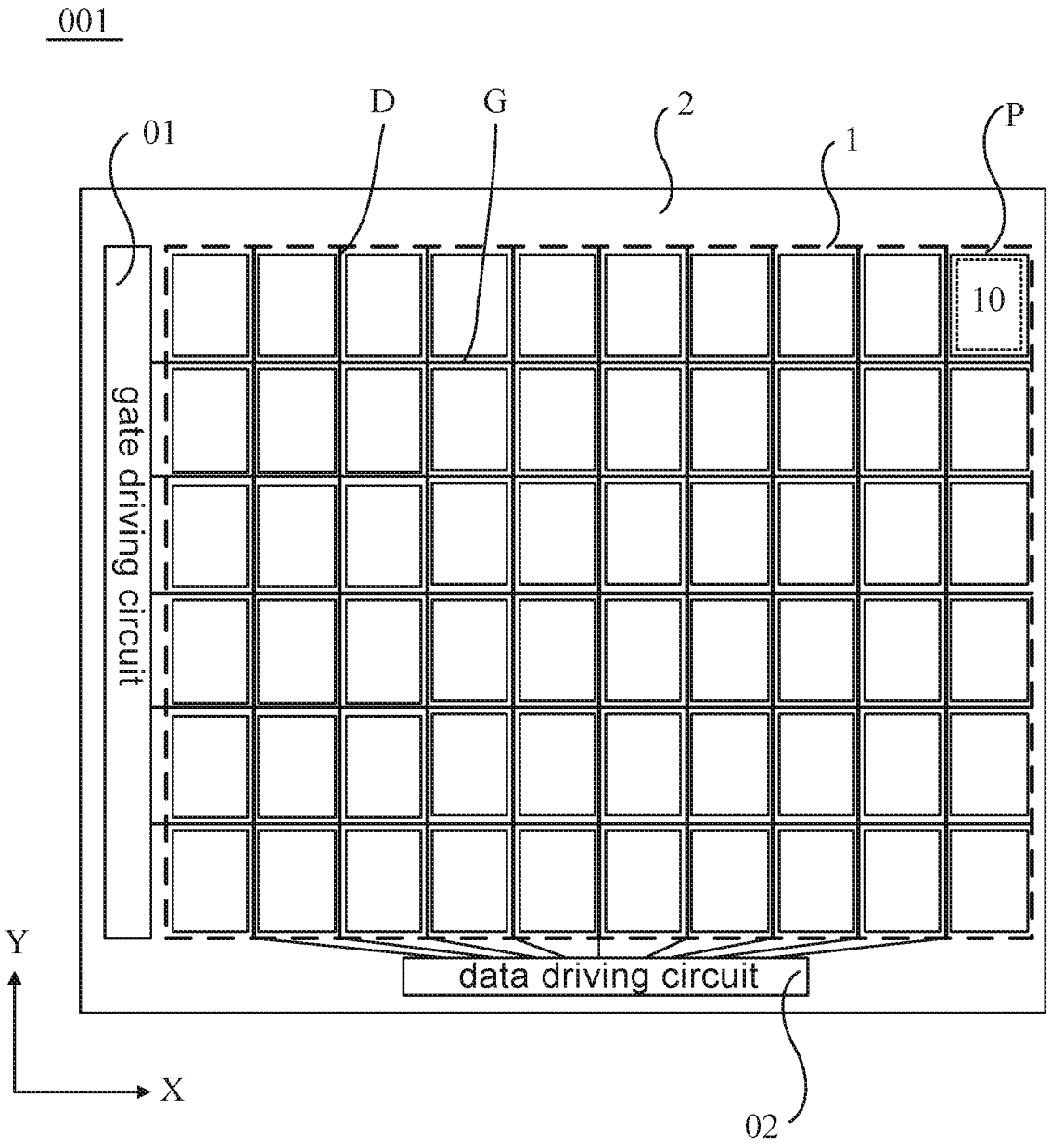
FIG. 1A is a schematic diagram of a display panel according to some embodiments.

Exemplary embodiments are described herein with reference to cross-sectional views and/or plan views that are idealized and exemplary drawings. In the drawings, thicknesses of layers and regions may be enlarged for clarity. Therefore, it may be conceived that shapes in the drawings can be correspondingly modified due to fabrication technologies and/or tolerances. Exemplary embodiments should not be construed as being limited to the shapes of the regions shown herein, and shall include, for example, deviations of shapes caused by fabrication. For example, a region illustrated as a rectangle will generally have curved features. Therefore, the regions illustrated in the drawings are schematic and their shapes are not intended to illustrate the actual shapes of the regions of an apparatus and are not intended to limit the scope of the exemplary embodiments.

DETAILED DESCRIPTION

Technical solutions in some embodiments of the present disclosure will be described clearly and completely with reference to accompanying drawings. Obviously, the described embodiments are merely some but not all of the embodiments of the present disclosure. All other embodiments obtained by a person of ordinary skill in the art based on the embodiments of the present disclosure shall be included in the protection scope of the present disclosure.

Unless the context requires otherwise, the term "comprise" and other forms thereof such as the third-person singular form "comprises" and the present participle form "comprising" in the description and the claims are construed as open and inclusive meaning, i.e., "include, but not limited to". In the description of the description, terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment or example. In addition, the specific features, structures, materials or characteristics may be included in any one or more embodiment(s) or example(s) in any suitable manner.

As following, the terms "first" and "second" are used for descriptive purposes only and are not to be construed as indicating or implying the relative importance or implicitly indicating the number of indicated technical features. Thus, features defined as "first" or "second" may explicitly or implicitly include one or more of the features. In the description of the embodiments of the present disclosure, the term "a/the plurality of" means two or more unless otherwise specified.

In the description of some embodiments, the term such as "connect" and its extensions may be used. For example, the term "connect" may be used in the description of some embodiments to indicate that two or more components are in direct physical or electrical contact with each other. The embodiments disclosed herein are not necessarily limited to the contents herein. The use of "suitable for" or "configured to" in the document means open-ended and inclusive language, which does not exclude devices that are suitable for or configured to perform additional tasks or steps.

In addition, in the document, orientation terms such as "upper", "lower", "left", "right", "horizontal", and "vertical" are defined relative to an orientation in which components in the drawings are schematically placed. It will be understood that these directional terms are relative concepts and used for relative description and clarification, which may be changed correspondingly according to changes in the orientation in which the components are placed in the drawings. Unless otherwise defined, technical terms or scientific terms used herein shall be understood as ordinary meanings by those skilled in the art.

Common display panels include organic light emitting diode (OLED) display panels, quantum dot light emitting diode (QLED) display panels, and micro light emitting diode (Micro LED) display panels.

In the related art, in a display process, a gate driving circuit in the OLED display panel may simultaneously provide scanning signals to multiple adjacent rows of pixel driving circuits in a certain period, that is, waveforms of the scanning signals received by the multiple adjacent rows of pixel driving circuits in the certain period have overlap portions. As a result, voltages of related control nodes in the pixel driving circuits may be unstable, and the display panel may have poor brightness uniformity.

The embodiments of the present disclosure are described below by taking the display panel being an OLED display panel as an example. For the case where the display panel is a display panel of another type, reference may be made to the description of the OLED display panel.

FIG. 1A is a schematic diagram of a display panel according to some embodiments. Referring to FIG. 1A, the display panel 001 has a display area 1 (also referred to as an active area (AA)) and a peripheral area 2 disposed on at least one side of the display area 1. For example, the peripheral area 2 disposed around the display area 1.

As shown in FIG. 1A, for example, the display panel 001 includes a plurality of gate lines G extending in a first direction and a plurality of data lines D extending in a second direction in the display area 1. The first direction is, for example, perpendicular to the second direction. For another example, an angle of the first direction and the second direction is an acute angle. Of course, all of the plurality of gate lines G and the plurality of data lines D may extend in a same direction, such as the second direction Y. The extending directions of the plurality of gate lines G and the plurality of data lines D can be set according to actual requirements, which are not limited thereto.

As shown in FIG. 1A, the display panel 001 further includes a plurality of sub-pixels P arranged in the display area 1, and each sub-pixel P is, for example, disposed in a region defined by corresponding gate lines G and corresponding data liens D that are arranged crosswise. The plurality of sub-pixels P at least include sub-pixels of a first color, sub-pixels of a second color, and sub-pixels of a third color. The first color, the second color and the third color are three primary colors (for example, red, green and blue, respectively). The plurality of sub-pixels P are arranged in a matrix, for example. In this case, sub-pixels P arranged in a row along the first direction X are referred to as sub-pixels in a same row. Sub-pixels P arranged in a column along the second direction Y are referred to as sub-pixels in a same column.

Of course, the plurality of sub-pixels may be arranged in other arrangements, for example, be arranged according actual requirements, as long as they can be divided into a plurality of rows of sub-pixels and divided into a plurality of columns of sub-pixels.

As shown in FIG. 1A, each sub-pixel P of the display panel 001 in the display area 1 includes a pixel driving circuit 10. Pixel driving circuits 10 in the plurality of sub-pixels P are capable of being divided into a plurality of rows of pixel driving circuits 10 each arranged in the first direction X and divided into a plurality of columns of pixel driving circuit 10 each arranged in the second direction Y. Pixel driving circuits 10 in sub-pixels P in a same row are electrically connected to at least one gate line G, and pixel driving circuits 10 in sub-pixels P in a same column are electrically connected to a data line D.

Figure 2A:
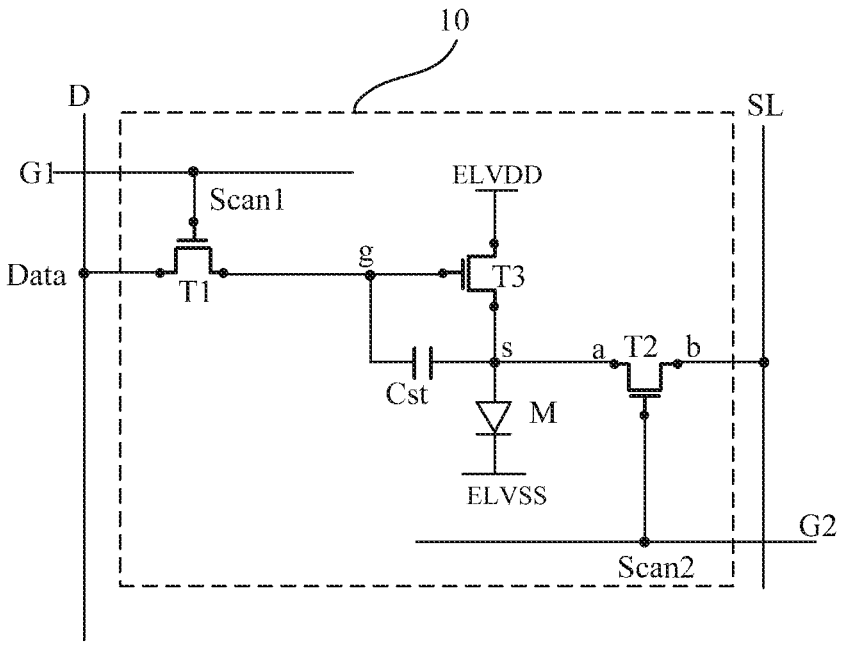
FIG. 2A is a circuit diagram of a pixel driving circuit according to some embodiments.
Figure 3:
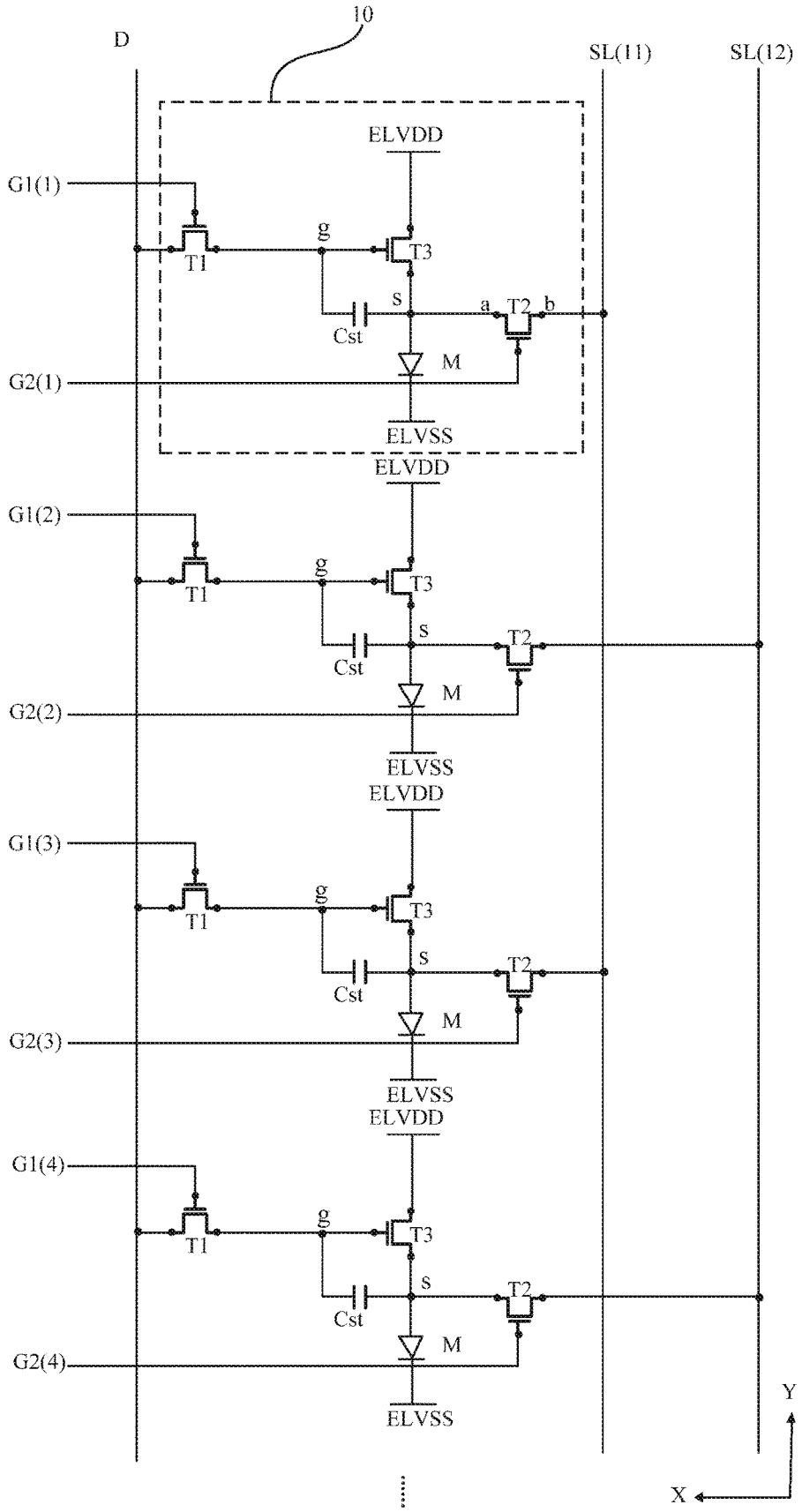
FIG. 3 is a schematic diagram of an arrangement of pixel driving circuits in a column in a display panel according to some embodiments.

For example, as shown in FIGS. 1A, 2A and 3, in the sub-pixels P in the same row, first scanning terminals Scan1 of the pixel driving circuits 10 are electrically connected to a first gate line G1, and second scanning terminals Scan2 of the pixel driving circuits 10 are electrically connected to a second gate line G2. That is, the pixel driving circuits 10 in the sub-pixels P in the same row correspond to two gate lines (i.e., the first gate line G1 and the second gate line G2). In addition, in the sub-pixels P in the same column, data signal terminals Data connected to the pixel driving circuits 10 are electrically connected to a data line D.

As shown in FIG. 1A, the display panel 001 further includes a gate driving circuit 01 and a data driving circuit 02 in the peripheral region 2, the gate driving circuit 01 is electrically connected to the plurality of gate lines G, and the data driving circuit 02 is electrically connected to the plurality of data lines D. In some examples, as shown in FIG. 1A, the gate driving circuit 01 is disposed at a side of an outermost data line D in the plurality of data lines D away from other data lines D, and the data driving circuit 02 is disposed at a side of an outermost gate line G in the plurality of gate lines G away from other gate lines G. The pixel driving circuits 10 are turned on row by row by the gate driving circuit 01. In a case where the pixel driving circuits 10 in a row are turned on, a pixel data voltage is written into each pixel driving circuit 10 in the row by the data driving circuit 02 to display an image.

In some embodiments, the gate driving circuit 01 is a gate driving IC. In some other embodiments, the gate driving circuit 01 is a gate driver on array (GOA) circuit. That is, the gate driving circuit 01 is directly integrated in an array substrate of the display panel 001. In this way, the manufacturing cost may be reduced, and a width of a frame of the display apparatus may also be narrowed.

Figure 1B:
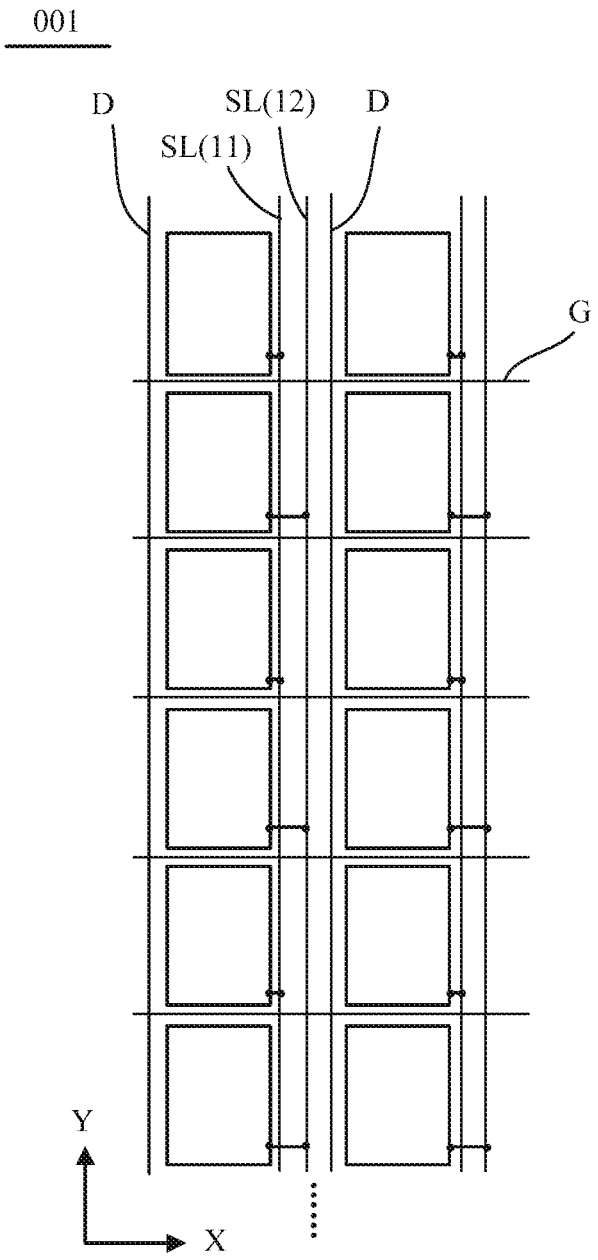
FIG. 1B is a schematic diagram of a portion of a display panel according to some embodiments.
Figure 1C:
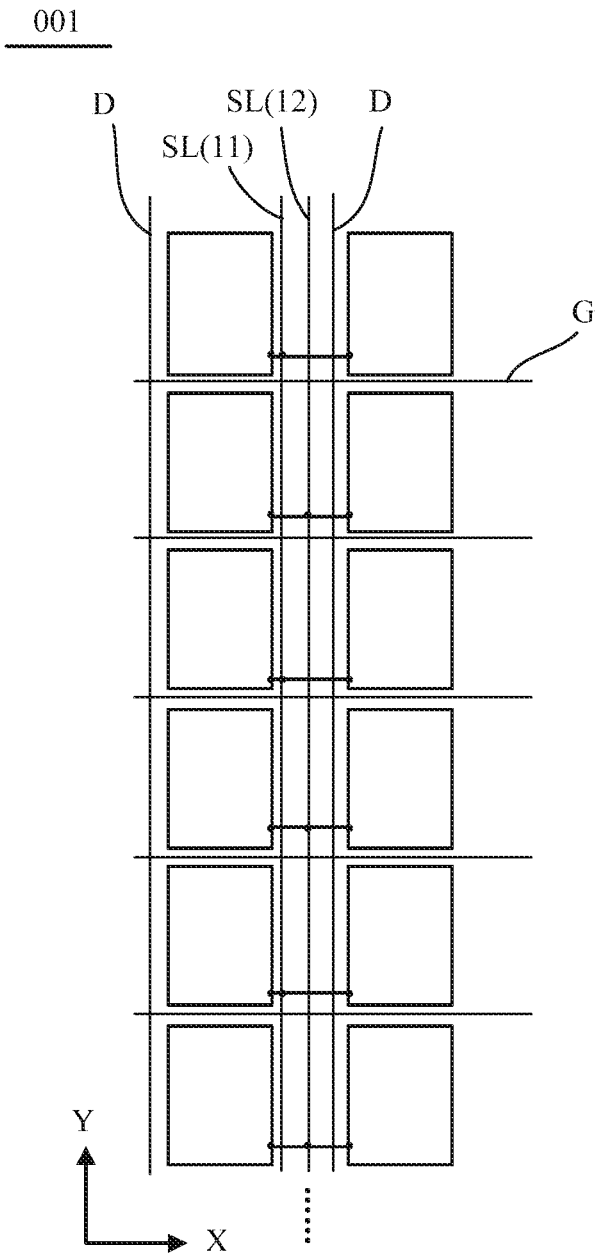
FIG. 1C is a schematic diagram of a portion of another display panel according to some embodiments.

In some embodiments, as shown in FIGS. 1B, 1C and 2A, the display panel 001 further includes a plurality of sense lines SL arranged at intervals and configured to provide reference voltage signals to the pixel driving circuits 10. The plurality of sense lines SL extend, for example, in the second direction. That is, the extending direction of the plurality of sense lines SL is the same as the extending direction of the plurality of data lines D. The pixel driving circuit 10 includes a detection transistor T2, and the detection transistor T2 is electrically connected to one of the plurality of sense lines SL. As shown in FIG. 3, in the pixel driving circuits 10 in the same column, detection transistors T2 in any two adjacent rows are electrically connected to different sense lines SL.

In the related art, second electrodes of detection transistors T2 in the pixel driving circuits 10 in the same column are electrically connected to a same sense line SL. In a case where the scanning signals received by the gates of the detection transistors T2 in multiple adjacent rows overlap (that is, the detection transistors T2 in the multiple adjacent rows are simultaneously turned on in a certain period), the plurality of detection transistors T2 are turned on at a same time, which may cause a current in the sense line SL to increase, and then an IR Drop generated in the sense line SL may be increased. In this way, when the display panel 001 displays an image, a voltage input to a first control node s through the detection transistor T2 by the sense line SL may have a large deviation. As a result, the display panel 001 has a problem of poor brightness uniformity during display.

In the embodiments of the present disclosure, in pixel driving circuits 10 in a same column, the detection transistors T2 in any two adjacent pixel driving circuits 10 are electrically connected to different sense lines SL. In this way, when a detection transistor T2 in a pixel driving circuit 10 is turned on, even if the detection transistor(s) T2 in one or more pixel driving circuits 10 adjacent to the pixel driving circuit 10 are turned on, it may not cause the current and the IR Drop in the sense line SL electrically connected to the pixel driving circuit 10 to increase. Furthermore, influence of turn-on of detection transistors T2 in a column of pixel driving circuits 10 on a potential at the first control node s is avoided. That is, an accuracy of the potential at the first control node s in the pixel driving circuit 10 is improved (i.e., the deviation of the potential at the first control node s is reduced), thereby improving the brightness uniformity of the display panel.

In some embodiments, the pixel driving circuits 10 in one column correspond to N sense lines, and N is an integer that is greater than or equal to two. In some examples, the number of the sense lines SL corresponding to each column of pixel driving circuits 10 is the same. In some other examples, the number of the sense lines SL corresponding to each column of the pixel driving circuits 10 is not exactly the same. For example, the number of the sense lines SL corresponding to a column of pixel driving circuits 10 is different from the number of the sense lines SL corresponding to an adjacent column of pixel driving circuits 10. Those skilled in the art may set the number of sense lines SL corresponding to one column of pixel driving circuit 10 according to the actual situation.

In some embodiments, as shown in FIG. 1B, the pixel driving circuits 10 in one column correspond to two sense lines SL, and pixel driving circuits 10 in the next column correspond to another two corresponding sense lines SL.

In some embodiments, multiple columns of pixel driving circuits 10 correspond to the same sense lines SL. For example, as shown in FIG. 1C, the pixel driving circuit 10 in one column and the pixel driving circuit 10 in the next column correspond to the same two sense lines. The correspondence between pixel driving circuits in one or more columns and the sense lines may be set according to actual needs, and is not limited thereto.

In the following embodiments of the present disclosure, an example where the number of sense lines SL corresponding to pixel driving circuits 10 in each column is the same is used for description.

In some embodiments, the detection transistors T2 in the pixel driving circuits 10 in the same column are electrically connected to the N sense lines SL corresponding to the pixel driving circuits 10 in the column sequentially and cyclically.

For example, as shown in FIG. 3, the pixel driving circuits 10 in the same column correspond to two sense lines SL(11) and SL(12), and second electrodes b of the detection transistors T2 in the pixel driving circuits 10 in the column are electrically connected to the two sense lines sequentially and cyclically. That is, the second electrodes of the detection transistors T2 in the pixel driving circuits 10 in odd-numbered rows are electrically connected to the sense line SL(11), and the second electrodes of the detection transistors T2 in the pixel driving circuits 10 in even-numbered rows are electrically connected to the other sense line SL(12). In FIG. 3 and the subsequent drawings, G1(*i*) represents a first gate line electrically connected to the pixel driving circuits 10 in an i-th row, and G2(*i*) represents a second gate line electrically connected to the pixel driving circuits 10 in the i-th row, in which i is an integer greater than or equal to 1.

Figure 4:
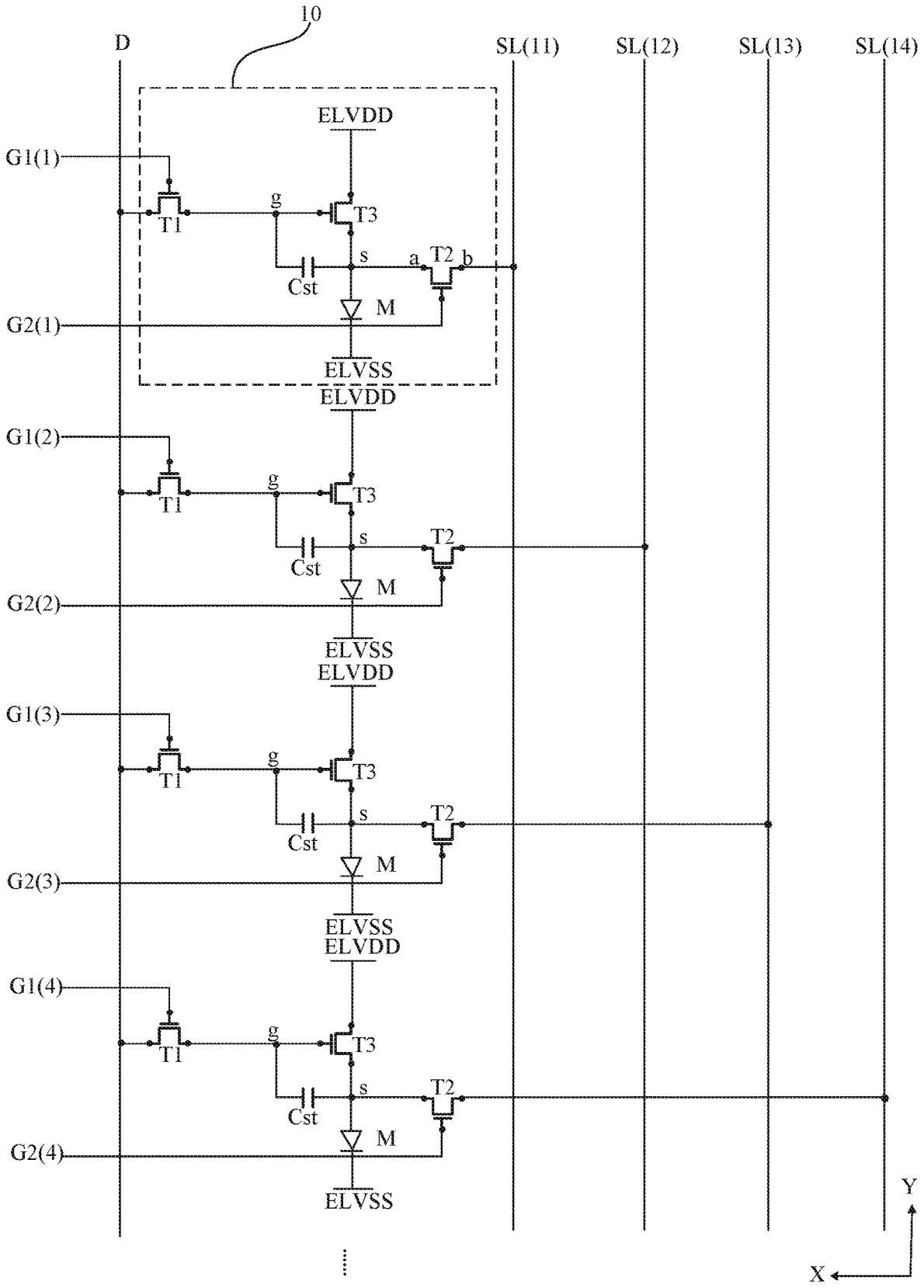
FIG. 4 is a schematic diagram of another arrangement of pixel driving circuits in a column in a display panel according to some embodiments.

For another example, as shown in FIG. 4, the pixel driving circuits 10 in the same column correspond to four sense lines SL(11), SL(12), SL(13), and SL(14). The second electrodes b of the detection transistors T2 in the pixel driving circuits 10 in the column are electrically connected to the four sense lines sequentially and cyclically. That is, in a case where N is equal to 4, in the pixel driving circuits 10 in the same column, the second electrode b of the detection transistor T2 in the pixel driving circuit 10 in a (4k+1)-th row is electrically connected to the sense line SL(11), the second electrode b of the detection transistor T2 in the pixel driving circuit 10 in a (4k+2)-th row is electrically connected to the sense line SL(12), the second electrode b of the detection transistor T2 in the pixel driving circuit 10 in a (4k+3)-th row is electrically connected to the sense line SL(13), and the second electrode b of the detection transistor T2 in the pixel driving circuit 10 in a (4k+4)-th row is electrically connected to the sense line SL(14), in which (4k+4) is less than or equal to the total number of rows of the pixel driving circuits 10 in the display panel 001, and k is an integer greater than or equal to 0, such as 0, 1, 2 . . . .

Figure 5:
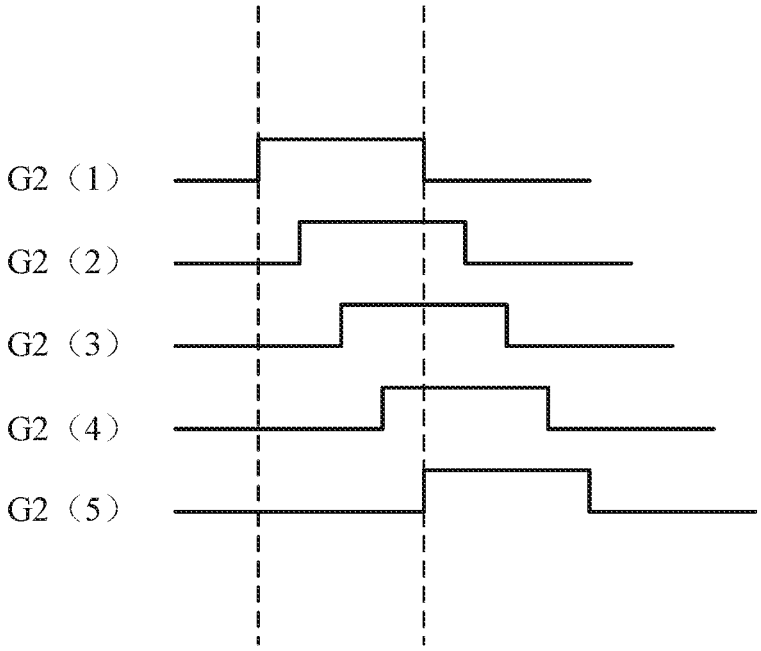
FIG. 5 is a timing diagram of scanning signals in a few rows of pixel driving circuits according to some embodiments.

In some embodiments, as shown in FIGS. 1A and 5, the gate driving circuit 01 is configured to provide second scanning signals to detection transistors in the pixel driving circuits in the same column, and the second scanning signals provided to detection transistors T2 in an i-th row to an (i+N−1)-th row in the pixel driving circuits in the column overlap in a signal cycle, and a second scanning signal provided to the detection transistor T2 in the i-th row does not overlap with a second scanning signal provided to a detection transistor T2 in an (i+N)-th row in the signal cycle, wherein i is an integer greater than or equal to 1. In this way, influence of the detection transistors T2 in the pixel driving circuits 10 in the other rows on the potential at the first control node s in the pixel driving circuit 10 in one row may be minimized.

It will be noted that the signal cycle means a frame time, that is, a period in which the plurality of rows of pixel driving circuits 10 are scanned sequentially.

That is, a period of a second scanning signal received by the detection transistors T2 in the i-th row overlaps with a period of a second scanning signal received by the detection transistors T2 in the (i+N−1)-th row; and the period of a second scanning signal received by the detection transistors T2 in the i-th row does not overlap with a period of a second scanning signal received by the detection transistors T2 in the (i+N)-th row.

For example, as shown in FIG. 5, a period of a second scanning signal received by detection transistors T2 in a first row (corresponding to G2(1)) overlaps with a period of a second scanning signal received by detection transistors T2 in a fourth row (corresponding to G2(4)), but does not overlap with a period of a scanning signal received by detection transistors T2 in a fifth row (corresponding to G2(5)). In this case, N is set to 4.

In a display process, the reference voltage signal needs to be input to the first control node s through the sense line SL, and the voltage at the first control node s needs to be collected. The related arrangement of the sense line SL is further described below.

Figure 6:
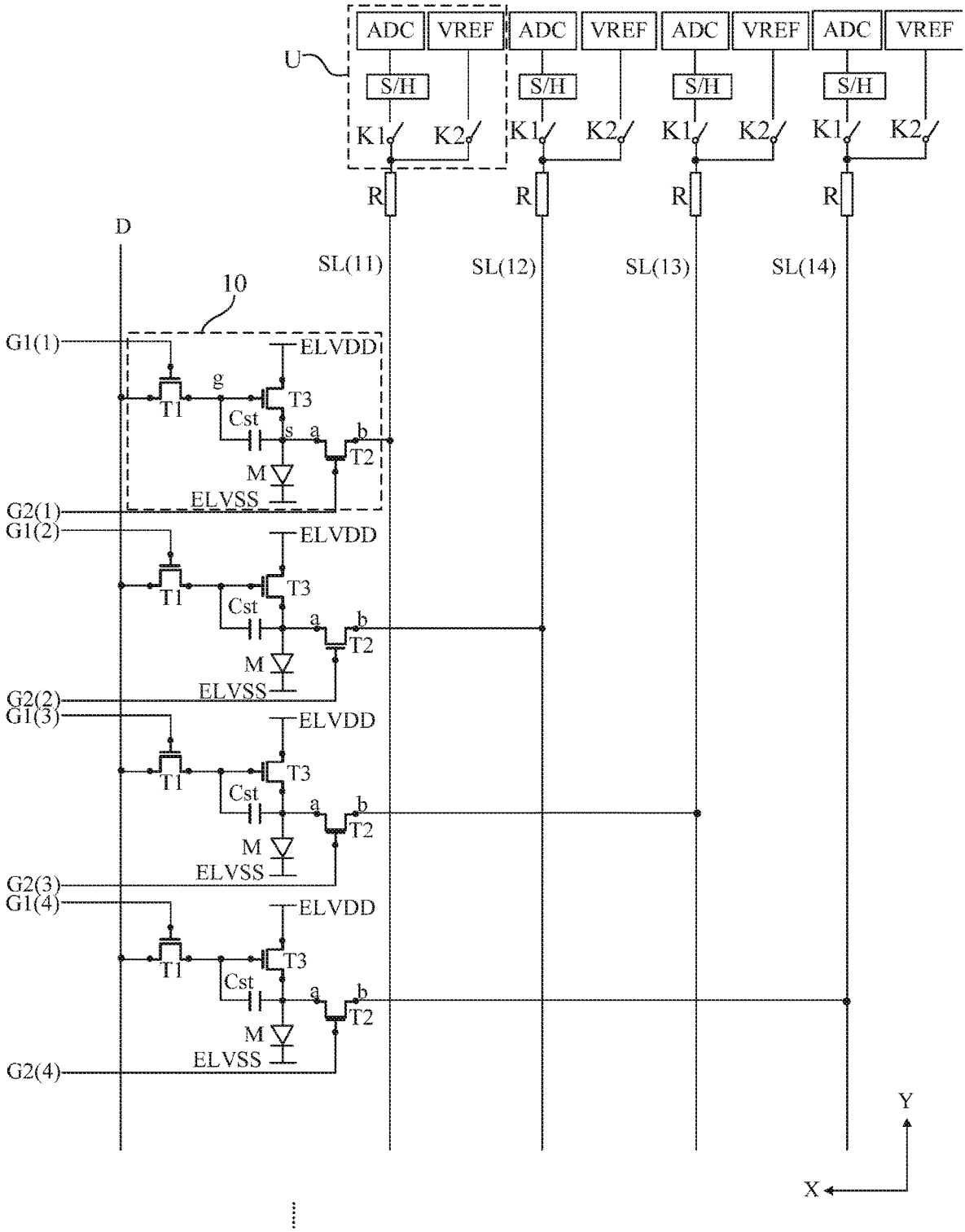
FIG. 6 is a schematic diagram of another arrangement of pixel driving circuits in a column in a display panel according to some embodiments.

In some embodiments, the display panel 001 further includes a plurality of controllers U. Each controller U is electrically connected to at least one sense line SL. For example, as shown in FIG. 6 (the resistance R electrically connected to the sense line SL in the figure represents an equivalent resistance of the sense line SL), the pixel driving circuits 10 in the same column correspond to 4 sense lines, and each sense line SL is electrically connected to a controller U (that is, the plurality of sense lines SL are respectively connected to different controllers U). The controller U, for example, includes a first switch K1, a second switch K2, a sample hold circuit S/H, and an analog-to-digital converter ADC. The sense line SL is electrically connected to the sample hold circuit S/H through the first switch K1, and the sample hold circuit S/H is electrically connected to the analog-to-digital converter ADC. The sense line SL is further electrically connected to a reference voltage terminal VREF through the second switch K2.

In an actual controlling process, the sample hold circuit S/H and the analog-to-digital converter ADC may sample the voltage at the first control node s by controlling the first switch K1 to be turned on and the second switch K2 to be turned off. In addition, the reference voltage signal Vref from the reference voltage terminal VREF may be provided to the pixel driving circuit 10 through the sense line SL by controlling the first switch K1 to be turned off and the second switch K2 to be turned on.

In some embodiments, the plurality of controllers U are integrated in an integrated circuit chip (IC chip), and the IC chip is disposed in the peripheral area 2 of the display panel 001 and at a side of the outermost gate line G away from the other gate lines G.

In some embodiments, as shown in FIG. 2A, in addition to the detection transistor T2, the pixel driving circuit 10 further includes a first switching transistor T1, a driving transistor T3, a storage capacitor Cst, and a light emitting device M.

A gate of the first switching transistor T1 is electrically connected to the first scanning terminal Scan1, a first electrode of the first switching transistor T1 is electrically connected to the data signal terminal Data, and the second electrode of the first switching transistor T1 is electrically connected to a first electrode of the storage capacitor Cst and a gate of the driving transistor T3 through the second control node g.

A first electrode of the storage capacitor Cst is further electrically connected to the gate of the driving transistor T3 through the second control node g, and a second electrode of the storage capacitor Cst is electrically connected to a second electrode of the driving transistor T3, a first electrode a of the detection transistor T2 one electrode of the light emitting device M through the first control node s.

A first electrode of the driving transistor T3 is electrically connected to a first power voltage terminal ELVDD, and the second electrode of the driving transistor T3 is further electrically connected to the one electrode of the light emitting device M, the second electrode of the storage capacitor Cst and the first electrode a of the detection transistor T2 through the first control node s.

A gate of the detection transistor T2 is electrically connected to the second scanning terminal Scan2, the first electrode a of the detection transistor T2 is further electrically connected to the one electrode of the light emitting device M through the first control node s, and the second electrode b of the detection transistor T2 is electrically connected to the sense line SL.

Another electrode of the light emitting device M is electrically connected to a second power voltage terminal ELVSS. The light emitting device M is, for example, an organic light emitting diode (OLED). An anode of the OLED is electrically connected to the first control node s, and a cathode of the OLED is electrically connected to the second power voltage terminal ELVSS.

It will be noted that the pixel driving circuit 10 is not limited to the circuit structure shown in FIG. 2A. In some embodiments, the pixel driving circuit 10 further includes other transistors. For example, the pixel driving circuit 10 further includes a transistor between the first electrode of the driving transistor T3 and the first power voltage terminal ELVDD, and a transistor between the second electrode of the driving transistor T3 and the light emitting device M, or the like.

Figure 2B:
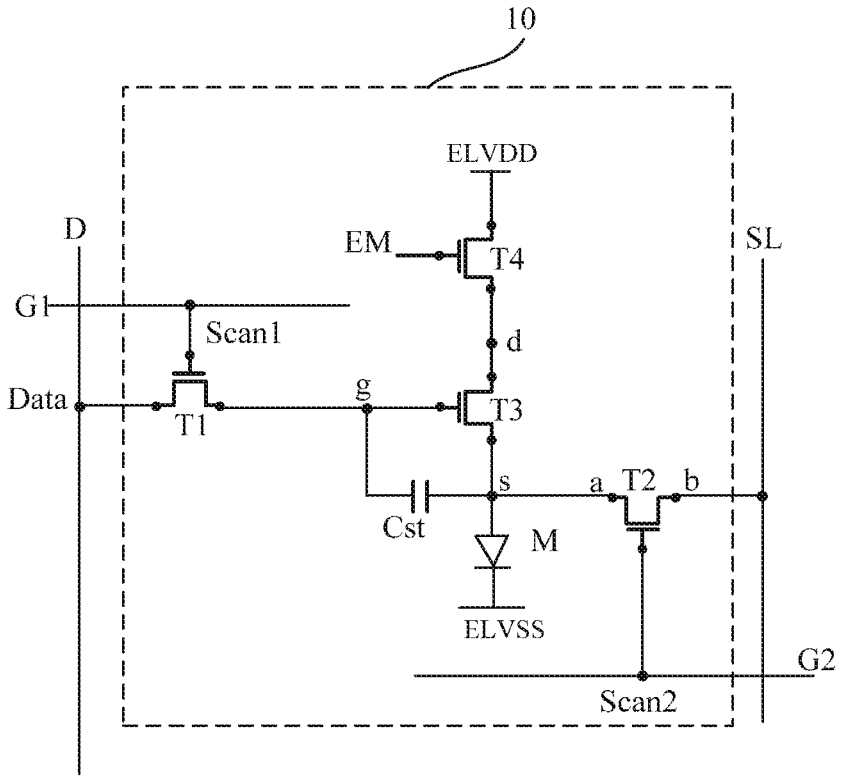
FIG. 2B is a circuit diagram of another pixel driving circuit according to some embodiments.

For example, as shown in FIG. 2B, the pixel driving circuit 10 further includes a second switching transistor T4. A gate of the second switching transistor T4 is electrically connected to a transmitting terminal EM, a first electrode of the second switching transistor T4 is electrically connected to the first power voltage terminal ELVDD, and a second electrode of the second switching transistor T4 is electrically connected to the first electrode of the driving transistor T3.

Some embodiments of the present disclosure provide a display apparatus. The display apparatus is, for example, a product having a display function, such as a television, a mobile phone, a computer, a notebook computer, a tablet computer, a personal digital assistant (PDA), or an onboard computer.

Figure 12:
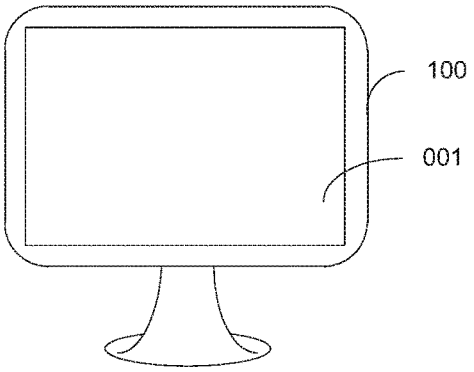
FIG. 12 is a schematic diagram of a display apparatus according to some embodiments.

As shown in FIG. 12, the display apparatus 100 includes the display panel 001 according to any one of the above embodiments. The display apparatus further includes, for example, a frame and other electronic accessories (such as a keyboard). The display panel is disposed in the frame.

The display panel in the display apparatus has the same structure and beneficial effects as the display panel provided in the foregoing embodiments. Since the structure and beneficial effects of the display panel have been described in the foregoing embodiments in detail, details are not described herein again.

Some embodiments of the present disclosure provide a method of controlling the display panel 001. The process of the display panel 001 displaying an image includes a display period and a compensation detection period. The display period of the display panel 001 includes a pixel data writing stage S1. The compensation detection period of the display panel 001 includes a data writing stage t1, a sampling stage t3, and a data writing-back stage t4. The method includes the steps in these two periods.

In the pixel data writing stage S1, scanning signals are provided to pixel driving circuits 10 in a row to turn on the pixel driving circuits 10 in the row, and the reference voltage signals Vref are provided to the pixel driving circuits 10 in the row through sense lines SL electrically connected to the pixel driving circuits 10 in the row.

In the data writing stage t1, scanning signals are provided to the pixel driving circuits 10 in the row to turn on the pixel driving circuits 10 in the row, and the reference voltage signals Vref are provided to the pixel driving circuits 10 in the row through the sense lines SL electrically connected to the pixel driving circuits 10 in the row.

In the sampling stage t3, scanning signals are provided to the pixel driving circuits in the row to turn on the pixel driving circuits 10 in the row, and voltages at sense lines SL electrically connected to the pixel driving circuits 10 in the row are collected.

In the data writing-back stage t4, scanning signals are provided to the pixel driving circuits in the row to turn on the pixel driving circuits 10 in the row, and the reference voltage signals Vref are provided to the pixel driving circuits 10 in the row through sense lines SL electrically connected to the pixel driving circuits 10 in the row.

A driving process of the pixel driving circuit 10 in the display panel 001 in the display period is described in detail below with reference to FIGS. 2A, 6, 7 and 10.

In the pixel data writing stage S1 of the display period of the display panel, the steps of providing scanning signals to pixel driving circuits in a row to turn on the pixel driving circuits in the row, and providing the reference voltage signals to the pixel driving circuits in the row through sense lines electrically connected to the pixel driving circuits in the row, include: providing first scanning signals to the first scanning terminals Scan1 to turn on the first switching transistors T1; and providing second scanning signals to the second scanning terminals Scan2 to turn on the detection transistors T2; providing pixel data voltages to the data signal terminals Data, which are then transmitted to the second control nodes g through the turned-on first switching transistors T1 and is stored in the storage capacitors Cst; and providing the reference voltage signals Vref to the sense lines SL, which are then transmitted to the first control nodes s through the turned-on detection transistors T2.

Figure 7:
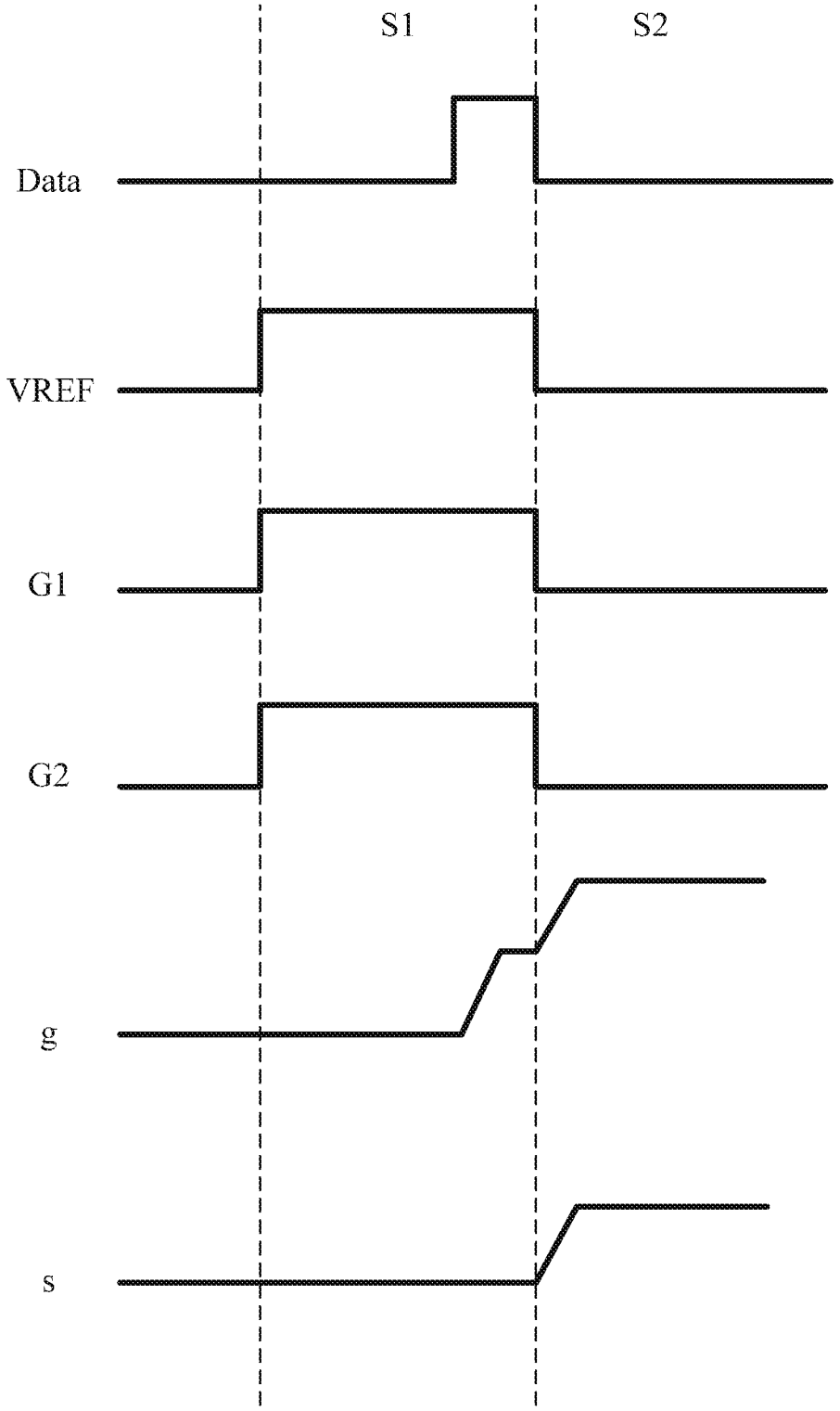
FIG. 7 is a timing diagram of a display panel during a display period according to some embodiments.
Figure 8:
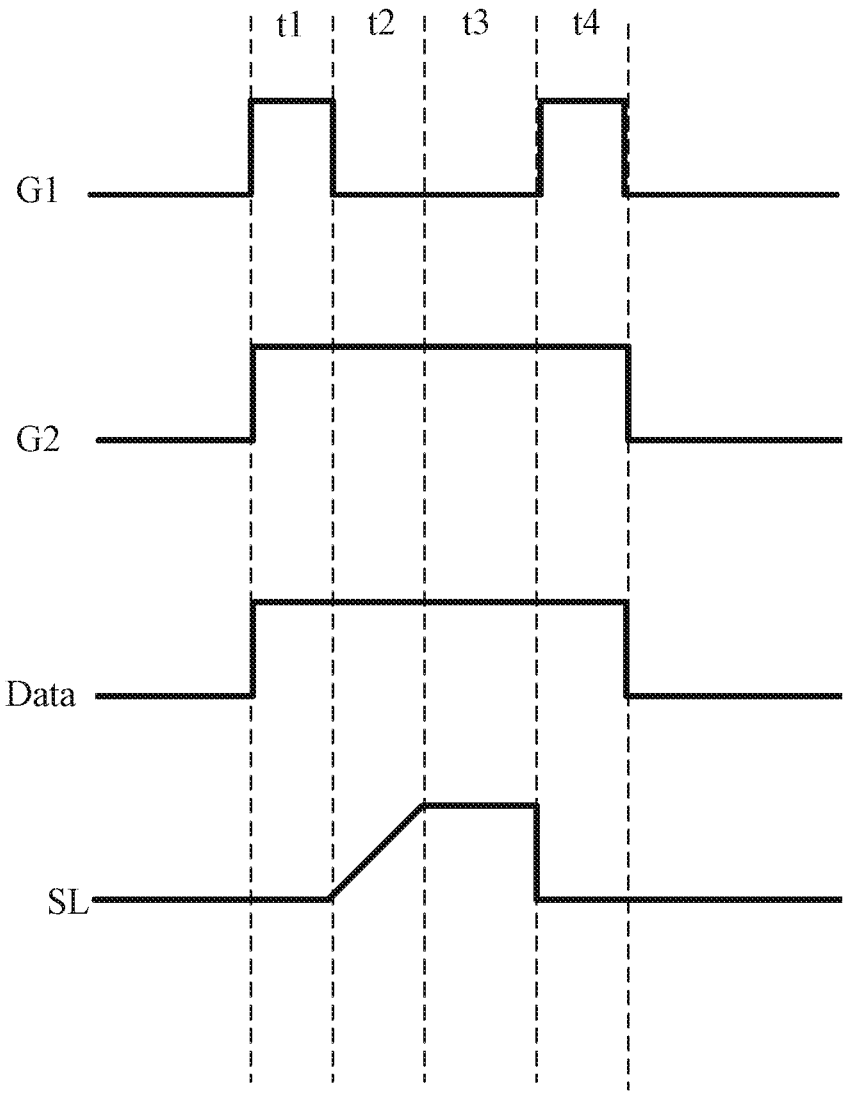
FIG. 8 is a timing diagram of a display panel during a compensation detection period according to some embodiments.

It will be understood that, as shown in FIG. 7, the writing period of the pixel data voltage (i.e., a pulse width of the pixel data voltage) corresponds to a last period in the period in which the first scanning signal is provided through the first gate line G1 and a first scanning signal is not provided through a first gate line disposed before this first gate line.

In the above process, the voltage at the second control node g gradually rises, the driving transistor T3 is turned on, the voltage at the first control node s gradually rises accordingly, and the voltage at the second control node g further rises due to a bootstrap effect of the storage capacitor Cst. Then, the pixel driving circuit 10 enters an emission stage S2 of the display period.

In some embodiments, referring to FIGS. 2A, 6, 7 and 10, the method of controlling the display panel further includes: in the emission stage S2 of the display period of the display panel, providing first cut-off signals to the first scanning terminals Scan1 in the pixel driving circuits 10 in the row to turn off the first switching transistors T1; and providing second cut-off signals to the second scanning terminals Scan2 in the pixel driving circuits 10 in the row to turn off the detection transistors T2, wherein the driving transistors T3 in the pixel driving circuits 10 in the row are turned on under control of the voltages at the second control nodes g, and the light emitting devices M in the driving circuits 10 emit light.

A driving process of the pixel driving circuit 10 in the display panel 001 in the compensation detection period is described below with reference to FIGS. 2A, 6, 8 and 11.

In the entire compensation detection period, second scanning signals are provided to the second scanning terminals Scan2, so that the detection transistors T2 remain turned on; and in the entire compensation detection period, pixel data voltages are continuously provided to the data signal terminals Data.

In the data writing stage t1 of the compensation detection period of the display panel, the steps of providing the scanning signals to the pixel driving circuits in a row to turn on the pixel driving circuits in the row, and providing the reference voltage signals to the pixel driving circuits in the row through the sense lines electrically connected to the pixel driving circuits in the row, include: providing first scanning signals to the first scanning terminals Scan1 to turn on the first switching transistors T1; providing pixel data voltages to data signal terminals, which are then transmitted to the second control nodes g through the turned-on first switching transistors T1 and is stored in the storage capacitors Cst; providing second scanning signals to the second scanning terminals Scan2 to turn on the detection transistors T2; and providing the reference voltage signals to the sense lines, which are then transmitted to the first control nodes s through the turned-on detection transistors T2.

In the sampling stage t3 of the compensation detection period of the display panel, the steps of providing scanning signals to the pixel driving circuits in the row to turn on the pixel driving circuits in the row, and collecting the voltages at the sense lines electrically connected to the pixel driving circuits in the row, include: providing first cut-off signals to the first scanning terminals Scan1 to turn off the first switching transistors T1; providing the second scanning signals to the second scanning terminals to turn on the detection transistors; and collecting the voltages at the sense lines SL (i.e., collecting the voltages at the first control nodes s in the pixel driving circuits 10).

In the data writing-back stage t4 of the compensation detection period of the display panel, the steps of providing scanning signals to the pixel driving circuits in the row to turn on the pixel driving circuits in the row, and providing the reference voltage signals to the pixel driving circuits in the row through the sense lines electrically connected to the pixel driving circuits in the row, include: providing the first scanning signals to the first scanning terminals Scan1 again to turn on the first switching transistors T1; providing the pixel data voltages to the data signal terminals, which are then transmitted to the second control nodes g through the turned-on first switching transistors; providing second scanning signals to the second scanning terminals to turn on the detection transistors T2; and providing the reference voltage signals Vref to the sense lines SL, which are then transmitted to the first control nodes s through the turned-on detection transistors T2.

It will be understood that a same gate line G may provide control signals (e.g., scanning signals or cut-off signals) to the pixel driving circuits 10 in the same row of sub-pixels P that are electrically connected to the gate line G, and a same data line D may provide pixel data voltages to the pixel driving circuits 10 in the same column of sub-pixels P that are electrically connected to the data line D. For example, the first gate line G1 provides first scanning signals to first scanning terminals Scan1 in a row of pixel driving circuits 10 that are electrically connected to the first gate line G1, the second gate line G2 provides second scanning signals to second scanning terminals Scan2 in a row of pixel driving circuits 10 that are electrically connected to the second gate line G2, and the data line D provides pixel data voltages to data signal terminals Data in a column of pixel driving circuits 10 that are electrically connected to the data line D.

Herein, in the display period, providing scanning signals to the pixel driving circuits 10 in the row to turn on the pixel driving circuits 10 means that the first scanning signals are provided through the first gate line G1 to the first scanning terminals Scan1 in the row of pixel driving circuits 10 that are electrically connected to the first gate line G1 to turn on the first switching transistors T1 in the row of the pixel driving circuits 10, and the second scanning signals are provided through the second gate line G2 to the second scanning terminals Scan2 in the row of the pixel driving circuits 10 to turn on the detection transistors T2 in the row of the pixel driving circuits 10. In the compensation detection period, providing scanning signals to the pixel driving circuits 10 in a row to turn on the pixel driving circuits 10 in the row includes the case in which the second scanning signals are provided through the second gate line G2 to the second scanning terminals Scan2 in the row of pixel driving circuits 10 that are electrically connected to the second gate line G2 to turn on the detection transistors T2.

In some embodiments, as shown in FIG. 6, the display panel 001 further includes a plurality of controllers U. Each controller U includes a first switch K1 and a second switch K2. Each sense line SL is electrically connected to the reference voltage terminal VREF through a second switch K2 in a controller U. In the pixel data writing stage S1, the data writing stage t1, and the data writing-back stage t4, the step of providing the reference voltage signals Vref to the pixel driving circuits in the row through the sense lines SL electrically connected to the pixel driving circuits in the row, includes: controlling the second switches K2 electrically connected to the pixel driving circuits 10 in the row through the sense lines SL to be turned on, and controlling second switches K2 electrically connected to the other sense lines SL and all first switches K1 to be turned off, so as to provide the reference voltage signals Vref from the reference voltage terminals VREF to the pixel driving circuits 10 in the row.

In some embodiments, as shown in FIG. 6, each controller U further includes a sample hold circuit S/H and an analog-to-digital converter ADC. The sense line SL is electrically connected to the sample hold circuit S/H through the first switch K1, and the sample hold circuit S/H is electrically connected to the analog-to-digital converter ADC. The sense line SL is further electrically connected to the reference voltage terminal VREF through the second switch K2. In the sampling stage t3, the step of collecting the voltages at the sense lines electrically connected to the pixel driving circuits in the row, includes: controlling the first switches K1 electrically connected to the pixel driving circuits 10 in the row through the sense lines SL to be turned on; controlling the first switches K1 electrically connected to the other sense lines SL and all second switches K2 to be turned off; collecting, by the sample hold circuit S/H, the voltages at the sense lines SL; and outputting, by the sample hold circuit S/H, the voltages to the analog-to-digital converters ADC. In some embodiments, the compensation detection period of the display panel further includes a charging stage t2 after the data writing stage t1. The method of controlling the display panel further includes: in the charging stage t2, providing first cut-off signals to the first scanning terminals Scan1 in the pixel driving circuits in the row to turn off the first switching transistors T1; providing second scanning signals to the second scanning terminals Scan2 in the pixel driving circuits 10 in the row to turn on the detection transistors T2; stopping providing the reference voltage signals Vref to the first control nodes s in the pixel driving circuits 10 in the row, so that the first control nodes s are in a floating state (i.e., no electrical signal is input to the first control node s), and the driving transistors T3 in the pixel driving circuits 10 in the row are turned on under control of the voltages at the second control nodes g to charge the sense lines SL electrically connected to the pixel driving circuits in the row.

In some embodiments, as shown in FIG. 6, the display panel 001 further includes a plurality of controllers U. Each controller U includes a first switch K1 and a second switch K2. Each sense line SL is electrically connected to the reference voltage terminal VREF through a second switch K2 in a controller U. In the pixel data writing stage S1, the data writing stage t1, and the data writing-back stage t4, the step of providing the reference voltage signals Vref to the sense lines SL, which are then transmitted to the first control nodes s through the turned-on detection transistors T2, includes: controlling the second switches K2 in the controllers U electrically connected to the sense lines SL to be turned on, and controlling the first switches K1 in the controllers U to be turned off, so as to transmit the reference voltage signals Vref from the reference voltage terminals VREF to the first control nodes s through the detection transistors T2.

In some embodiments, as shown in FIG. 6, each controller U includes a first switch K1, a second switch K2, a sample hold circuit S/H, and an analog-to-digital converter ADC. The sense line SL is electrically connected to the sample hold circuit S/H through the first switch K1 and the sample hold circuit S/H is electrically connected to the analog-to-digital converter ADC. The sense line SL is further electrically connected to the reference voltage terminal VREF through the second switch K2. In the sampling stage t3, the step of collecting the voltages at the sense lines SL (i.e., collecting the voltages at the first control nodes s in the pixel driving circuits 10) includes: controlling the first switches K1 electrically connected to the sense lines SL to be turned on; controlling the second switches K2 electrically connected to the sense lines SL to be turned off; collecting, by the sample hold circuits S/H, the voltages at the first control nodes s in the pixel driving circuits 10; and converting, by the analog-to-digital converters ADC, the voltages into corresponding digital signals.

For the collected digital signals corresponding to the voltages at the first control nodes s, a threshold voltage of the driving transistor may be obtained through subsequent process such as data processing and calculation. In this way, in the subsequent display time, the pixel data voltage is compensated according to the threshold voltage for display, which is not limited herein.

Those skilled in the art would understand that, for a driving process of the pixel driving circuits 10 in the same row of sub-pixels P, reference may be made to the above steps, and details will not be described herein again.

In some embodiments, the method of controlling the display panel 001 includes steps in a reset stage q1, a compensation stage q2, a waiting stage q3, a data input stage q4, and a light-emitting stage q5.

Figure 9:
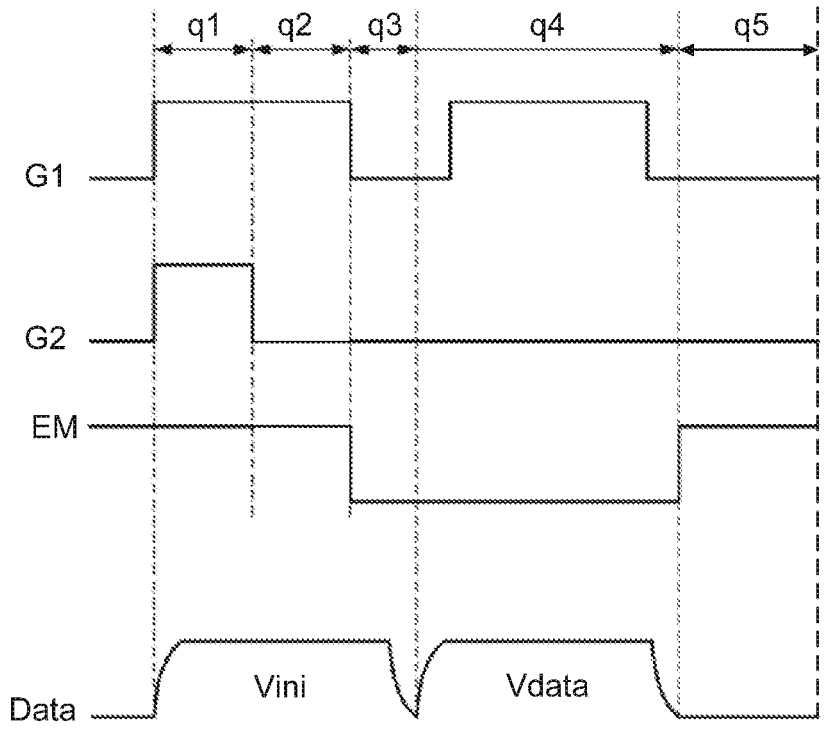
FIG. 9 is a timing diagram of another display panel in a driving process according to some embodiments.
Figure 10:
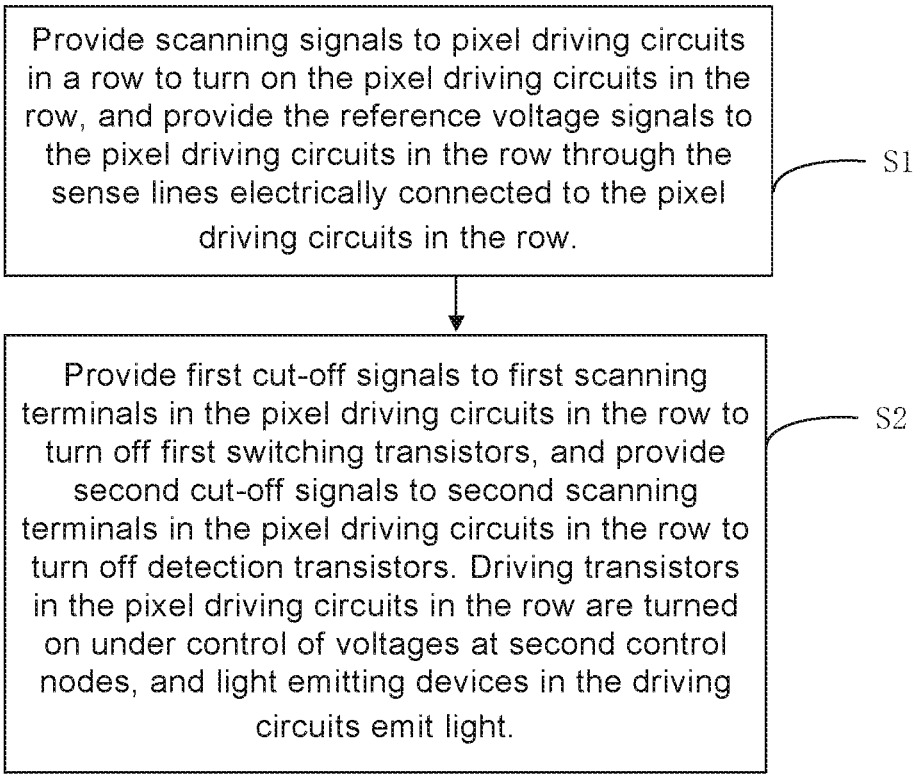
FIG. 10 is a flowchart of a method of controlling a display panel during a display period according to some embodiments.
Figure 11:
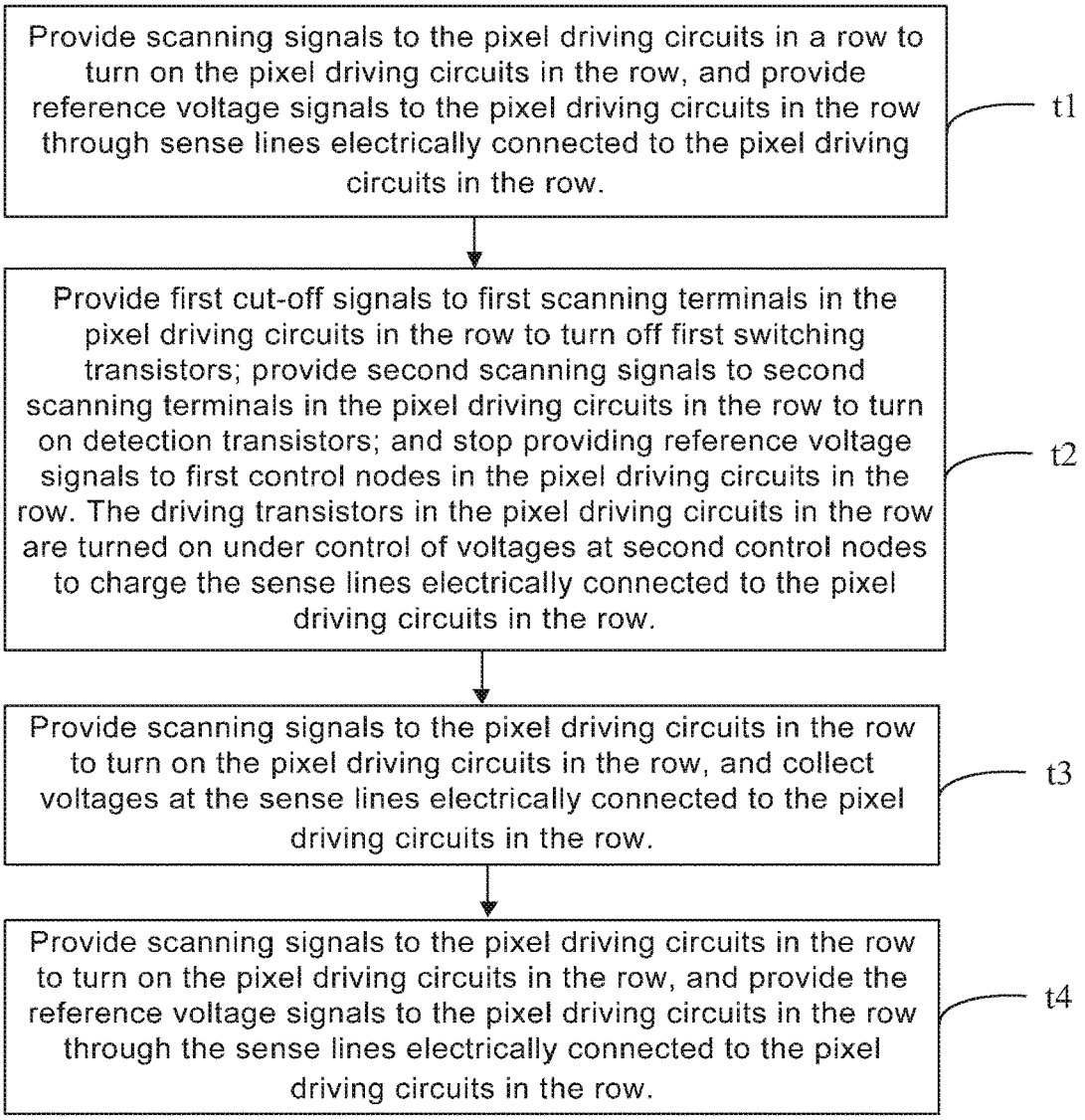
FIG. 11 is a flowchart of a method of controlling a display panel during a compensation detection period according to some embodiments.

A driving process of the display panel 001 is described below with reference to FIGS. 2B and 9.

In the reset stage q1: a first scanning signal is provided to the first scanning terminal Scan1 to turn on the first switching transistor T1; an initial voltage Vini is provided to the data signal terminal Data, which is then transmitted to the second control node g through the turned-on first switching transistor T1; a second scanning signal is provided to the second scanning terminal Scan2 to turn on the detection transistor T2; the reference voltage signal Vref is provided through the sense line SL electrically connected to the second electrode of the detection transistor T2, which is then transmitted to the first control node s through the turned-on detection transistor T2; a transmitting signal is provided to the transmitting terminal EM to turn on the second switching transistor T4; and a voltage is provided to the first power voltage terminal ELVDD, which is then transmitted to the third control node d through the turned-on second switching transistor T4.

In the compensation stage q2: the first scanning signal is provided to the first scanning terminal Scan1 to turn on the first switching transistor T1; the initial voltage Vini is provided to the data signal terminal Data, which is then transmitted to the second control node g through the turned-on first switching transistor T1; a second cut-off signal is provided to the second scanning terminal Scan2 to turn off the detection transistor; a transmitting signal is provided to the transmitting terminal EM to turn on the second switching transistor T4; and a voltage is provided to the first power voltage terminal ELVDD, which is then transmitted to the third control node d through the turned-on second switching transistor T4.

In the waiting stage q3: a first cut-off signal, the second cut-off signal, and a transmitting cut-off signal are respectively provided to the first scanning terminal Scan1, the second scanning terminal Scan2, and the transmitting terminal EM to turn off the first switching transistor T1, the detection transistor T2, and the second switching transistor T4.

In the data input stage q4: the first scanning signal is provided to the first scanning terminal Scan1 to turn on the first switching transistor T1; a pixel data voltage Vdata is provided to the data signal terminal Data, which is then transmitted to the second control node g through the turned-on first switching transistor T1; a second cut-off signal is provided to the second scanning terminal Scan2 to turn off the detection transistor T2; and a transmitting cut-off signal is provided to the transmitting terminal EM to turn off the second switching transistor T4.

In the light-emitting stage q5: the first cut-off signal and the second cut-off signal are respectively provided to the first scanning terminal Scan1 and the second scanning terminal Scan2 to turn off the first switching transistor T1 and the detection transistor T2, wherein the driving transistor T3 is turned on under control of the voltage at the second control node g; a transmitting signal is provided to the transmitting terminal EM to turn on the second switching transistor T4; and a voltage is provided to the first power voltage terminal ELVDD, which is then transmitted to the light emitting device M through the turned-on driving transistor T3 and the turned-on second switching transistor T4 to drive the light emitting device M to emit light.

It will be noted that the method of controlling the display panel may be performed by one or more processors, one or more driving integrated circuit (IC), or other circuits.

Those skilled in the art may understand that, since the driving process includes providing the initial voltage Vini and the pixel data voltage Vdata, the data driving circuit 02 in the display panel 001 includes a component that provides the initial voltage Vini and a component that provides the pixel data voltage Vdata.

In addition, in the circuits provided by the embodiments of the present disclosure, that all transistors are N-type transistors is taken as an example for description. It will be noted that the embodiments of the present disclosure include but are not limited to this. For example, one or more transistors in the circuits provided by the embodiments of the present disclosure may also be P-type transistor(s). Electrodes of the transistors with determined types are accordingly connected with reference to the electrodes of the transistors in the embodiments of the present disclosure, and voltage terminals provide corresponding high voltage or low voltages.

The forgoing descriptions are merely specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A method of controlling a display panel, wherein the display panel comprises:

a plurality of pixel driving circuits that are capable of being divided into a plurality of rows of pixel driving circuits each arranged in a first direction and divided into a plurality of columns of pixel driving circuit each arranged in a second direction intersected with the first direction, wherein each pixel driving circuit includes a detection transistor; and a plurality of sense lines arranged at intervals and extending along the second direction, the plurality of sense lines being configured to provide reference voltage signals to the plurality of pixel driving circuits, wherein each detection transistor is electrically connected to one of the plurality of sense lines, and in pixel driving circuits in a same column, detection transistors in any two adjacent rows are electrically connected to different sense lines;

wherein the method comprises:

in a pixel data writing stage of a display period of the display panel;

providing scanning signals to pixel driving circuits in a row to turn on the pixel driving circuits in the row, and providing reference voltage signals to the pixel driving circuits in the row through sense lines electrically connected to the pixel driving circuits in the row;

in a data writing stage of a compensation detection period of the display panel;

providing scanning signals to the pixel driving circuits in the row to turn on the pixel driving circuits in the row, and providing the reference voltage signals to the pixel driving circuits in the row through the sense lines electrically connected to the pixel driving circuits in the row;

in a sampling stage of the compensation detection period of the display panel;

providing scanning signals to the pixel driving circuits in the row to turn on the pixel driving circuits in the row, and collecting voltages at the sense lines electrically connected to the pixel driving circuits in the row; and in a data writing-back stage of the compensation detection period of the display panel;

providing scanning signals to the pixel driving circuits in the row to turn on the pixel driving circuits in the row, and providing the reference voltage signals to the pixel driving circuits in the row through the sense lines electrically connected to the pixel driving circuits in the row.

2. The method according to claim 1, wherein in a case where the display panel further includes a plurality of controllers, each controller includes a first switch and a second switch, and each sense line is electrically connected to a reference voltage terminal through a second switch in a controller, providing the reference voltage signals to the pixel driving circuits in the row through the sense lines electrically connected to the pixel driving circuits in the row, includes:

controlling second switches electrically connected to the pixel driving circuits in the row through the sense lines to be turned on, and controlling second switches electrically connected to remaining sense lines and all first switches to be turned off to provide the reference voltage signals from the reference voltage terminals to the pixel driving circuits in the row.

3. The method according to claim 2, wherein in a case where the controller further includes a sample hold circuit and an analog-to-digital converter, the sense line electrically connected to the controller is electrically connected to the sample hold circuit through the first switch, and the sample hold circuit is electrically connected to the analog-to-digital converter, collecting the voltages at the sense lines electrically connected to the pixel driving circuits in the row, includes:

controlling first switches electrically connected to the pixel driving circuits in the row through the sense lines to be turned on;

controlling first switches electrically connected to remaining sense lines and all second switches to be turned off, collecting, by sample hold circuits, the voltages at the sense lines; and outputting, by the sample hold circuits, the voltages to analog-to-digital converters.

4. A method of controlling a display panel, wherein the display panel comprises:

a plurality of pixel driving circuits that are capable of being divided into a plurality of rows of pixel driving circuits each arranged in a first direction and divided into a plurality of columns of pixel driving circuit each arranged in a second direction intersected with the first direction, wherein each pixel driving circuit includes a detection transistor; and a plurality of sense lines arranged at intervals and extending along the second direction, the plurality of sense lines being configured to provide reference voltage signals to the plurality of pixel driving circuits, wherein each detection transistor is electrically connected to one of the plurality of sense lines, and in pixel driving circuits in a same column, detection transistors in any two adjacent rows are electrically connected to different sense lines;

wherein the method comprises:

in a pixel data writing stage of a display period of the display panel;

providing scanning signals to pixel driving circuits in a row to turn on the pixel driving circuits in the row, and providing reference voltage signals to the pixel driving circuits in the row through sense lines electrically connected to the pixel driving circuits in the row;

in a data writing stage of a compensation detection period of the display panel;

providing scanning signals to the pixel driving circuits in the row to turn on the pixel driving circuits in the row, and providing the reference voltage signals to the pixel driving circuits in the row through the sense lines electrically connected to the pixel driving circuits in the row;

in a sampling stage of the compensation detection period of the display panel;

providing scanning signals to the pixel driving circuits in the row to turn on the pixel driving circuits in the row, and collecting voltages at the sense lines electrically connected to the pixel driving circuits in the row; and in a data writing-back stage of the compensation detection period of the display panel;

providing scanning signals to the pixel driving circuits in the row to turn on the pixel driving circuits in the row, and providing the reference voltage signals to the pixel driving circuits in the row through the sense lines electrically connected to the pixel driving circuits in the row;

wherein in a case where each pixel driving circuit further includes a first switching transistor, a driving transistor, a storage capacitor, and a light emitting device; a gate of the detection transistor is electrically connected to a second scanning terminal, a first electrode of the detection transistor is electrically connected to a first control node, and a second electrode of the detection transistor is electrically connected to a sense line; a gate of the first switching transistor is electrically connected to a first scanning terminal, a first electrode of the first switching transistor is electrically connected to a data signal terminal, and a second electrode of the first switching transistor is electrically connected to a second control node; a first electrode of the storage capacitor is electrically connected to the second control node, and a second electrode of the storage capacitor is electrically connected to the first control node; a first electrode of the driving transistor is electrically connected to a first power voltage terminal, a second electrode of the driving transistor is electrically connected to the first control node, and a gate of the driving transistor is electrically connected to the second control node; and one electrode of the light emitting device is electrically connected to the first control node, and another electrode of the light emitting device is electrically connected to a second power voltage terminal, in the pixel data writing stage of the display period of the display panel, providing scanning signals to the pixel driving circuits in the row to turn on the pixel driving circuits in the row, and providing the reference voltage signals to the pixel driving circuits in the row through the sense lines electrically connected to the pixel driving circuits in the row, include:

providing first scanning signals to first scanning terminals to turn on first switching transistors;

providing pixel data voltages to data signal terminals, which are then transmitted to second control nodes through the first switching transistors;

providing second scanning signals to second scanning terminals to turn on detection transistors; and providing the reference voltage signals to the sense lines, which are then transmitted to first control nodes through the detection transistors;

in the data writing stage of the compensation detection period of the display panel, providing scanning signals to the pixel driving circuits in the row to turn on the pixel driving circuits in the row, and providing the reference voltage signals to the pixel driving circuits in the row through the sense lines electrically connected to the pixel driving circuits in the row, include:

providing first scanning signals to the first scanning terminals to turn on the first switching transistors;

providing pixel data voltages to the data signal terminals, which are then transmitted to the second control nodes through the first switching transistors;

providing second scanning signals to the second scanning terminals to turn on the detection transistors; and providing reference voltage signals to the sense lines, which are then transmitted to the first control nodes through the detection transistors;

in the sampling stage of the compensation detection period of the display panel, providing scanning signals to the pixel driving circuits in the row to turn on the pixel driving circuits in the row, and collecting the voltages at the sense lines electrically connected to the pixel driving circuits in the row, include:

providing first cut-off signals to the first scanning terminals to turn off the first switching transistors;

providing second scanning signals to the second scanning terminals to turn on the detection transistors; and collecting voltages at the first control nodes in the pixel driving circuits in the row; and in the data writing-back stage of the compensation detection period of the display panel, providing scanning signals to the pixel driving circuits in the row to turn on the pixel driving circuits in the row, and providing the reference voltage signal to the pixel driving circuits in the row through the sense lines electrically connected to the pixel driving circuits in the row, include:

providing first scanning signals to the first scanning terminals to turn on the first switching transistors;

providing pixel data voltages to the data signal terminals, which are then transmitted to the second control nodes through the first switching transistors;

providing second scanning signals to the second scanning terminals to turn on the detection transistors; and providing reference voltage signals to the sense lines, which are then transmitted to the first control nodes through the detection transistors.

5. The method according to claim 4, wherein in a case where the display panel further includes a plurality of controllers, each controller includes a first switch and a second switch, and each sense line is electrically connected to a reference voltage terminal through a second switch in a controller, providing the reference voltage signals to the pixel driving circuits in the row through the sense lines electrically connected to the pixel driving circuits in the row, includes:

controlling second switches electrically connected to the pixel driving circuits in the row through the sense lines to be turned on, and controlling second switches electrically connected to remaining sense lines and all first switches to be turned off to provide the reference voltage signals from the reference voltage terminals to the pixel driving circuits in the row.

6. The method according to claim 5, wherein in a case where the controller further includes a sample hold circuit and an analog-to-digital converter, the sense line electrically connected to the controller is electrically connected to the sample hold circuit through the first switch, and the sample hold circuit is electrically connected to the analog-to-digital converter, collecting the voltages at the sense lines electrically connected to the pixel driving circuits in the row, includes:

controlling first switches electrically connected to the pixel driving circuits in the row through the sense lines to be turned on;

controlling first switches electrically connected to remaining sense lines and all second switches to be turned off;

collecting, by sample hold circuits, the voltages at the sense lines; and outputting, by the sample hold circuits, the voltages to analog-to-digital converters.

7. The method according to claim 4, wherein in a case where the display panel further includes a plurality of controllers, each controller includes a first switch and a second switch, and each sense line is electrically connected to the reference voltage terminal through a second switch in a controller, providing the reference voltage signals to the sense lines, which are then transmitted to the first control nodes through the detection transistors, includes:

controlling second switches in controllers electrically connected to the sense lines to be turned on, and controlling first switches in the controllers to be turned off, so as to transmit the reference voltage signals from the reference voltage terminals to the first control nodes through the detection transistors.

8. The method according to claim 7, wherein in a case where the controller further includes a sample hold circuit and an analog-to-digital converter, the sense line electrically connected to the controller is electrically connected to the sample hold circuit through the first switch, and the sample hold circuit is electrically connected to the analog-to-digital converter, collecting the voltages at the first control nodes in the pixel driving circuits, includes:

controlling first switches electrically connected to the sense lines to be turned on;

controlling second switches electrically connected to the sense lines to be turned off, so as to transmit the voltages at the first control nodes in the pixel driving circuits through the detection transistors;

collecting, by the sample hold circuits, the voltages; and converting, by analog-to-digital converters, the voltages into corresponding digital signals.

9. The method according to claim 4, further comprising:

in an emission stage of the display period of the display panel;

providing first cut-off signals to the first scanning terminals in the pixel driving circuits in the row to turn off the first switching transistors; and providing second cut-off signals to the second scanning terminals in the pixel driving circuits in the row to turn off the detection transistors, wherein driving transistors in the pixel driving circuits in the row are turned on under control of voltages at the second control nodes, and light emitting devices in the driving circuits in the row emit light.

10. The method according to claim 4, further comprising:

after the data writing stage in the compensation detection period, and in a charging stage of the compensation detection period of the display panel;

providing first cut-off signals to the first scanning terminals in the pixel driving circuits in the row to turn off the first switching transistors;

providing second scanning signals to the second scanning terminals in the pixel driving circuits in the row to turn on the detection transistors;

stopping providing the reference voltage signals to the first control nodes in the pixel driving circuits in the row, wherein the driving transistors in the pixel driving circuits in the row are turned on under control of voltages at the second control nodes to charge the sense lines electrically connected to the pixel driving circuits in the row.

* * * * *